US008869452B2

(12) United States Patent
Royer et al.

(10) Patent No.: US 8,869,452 B2
(45) Date of Patent: Oct. 28, 2014

(54) ROAD DEVICE

(75) Inventors: Jean-Claude Royer, Lesmenils (FR); Vincent Rotharmel, Vandieres (FR)

(73) Assignee: Saint-Gobain Pam, Nancy (FR)

( * ) Notice: Subject to any disclaimer, the term of this patent is extended or adjusted under 35 U.S.C. 154(b) by 0 days.

(21) Appl. No.: 13/643,218

(22) PCT Filed: Apr. 28, 2011

(86) PCT No.: PCT/FR2011/050960

§ 371 (c)(1),
(2), (4) Date: Nov. 27, 2012

(87) PCT Pub. No.: WO2011/135260

PCT Pub. Date: Nov. 3, 2011

(65) Prior Publication Data

US 2013/0097933 A1 Apr. 25, 2013

(30) Foreign Application Priority Data

Apr. 29, 2010 (FR) ..... 10 53341

(51) Int. Cl.
*E02D 29/14* (2006.01)

(52) U.S. Cl.
CPC ..... *E02D 29/14* (2013.01); *E02D 29/1463* (2013.01)
USPC ..... 49/402; 49/400; 404/25

(58) Field of Classification Search
USPC ..... 49/33, 131, 149, 188, 189, 381, 49/400–402, 463, 465; 404/25, 26; 52/19–21
See application file for complete search history.

(56) References Cited

U.S. PATENT DOCUMENTS

| | | | | |
|---|---|---|---|---|
| 3,455,059 | A * | 7/1969 | Evans | 49/397 |
| 4,508,469 | A * | 4/1985 | Dumortier | 404/25 |
| 5,017,039 | A * | 5/1991 | Spiess et al. | 404/25 |
| 5,160,213 | A * | 11/1992 | Spiess et al. | 404/25 |
| 7,160,051 | B1 * | 1/2007 | Cuny et al. | 404/25 |
| 7,448,512 | B2 * | 11/2008 | Hauer et al. | 220/817 |
| 7,866,915 | B2 * | 1/2011 | Pendleton et al. | 404/25 |
| 7,908,798 | B2 * | 3/2011 | Monneret | 52/20 |
| 7,942,289 | B2 * | 5/2011 | Hauer et al. | 220/817 |
| 8,006,439 | B2 * | 8/2011 | Hauer et al. | 52/19 |
| 2005/0175409 | A1 | 8/2005 | Hauer et al. | |

FOREIGN PATENT DOCUMENTS

| | | |
|---|---|---|
| DE | 4208453 | 9/1993 |
| EP | 1091046 | 4/2001 |
| EP | 1160382 | 12/2001 |
| FR | 2548254 | 1/1985 |
| FR | 2922908 | 5/2009 |

* cited by examiner

*Primary Examiner* — Katherine Mitchell
*Assistant Examiner* — Abe Massad
(74) *Attorney, Agent, or Firm* — Thompson Coburn LLP

(57) ABSTRACT

A road device such as a telecommunications access hatch having a frame that delimits an opening, a cover, a first hinge provided with a first cam and a first cam follower, which are designed to guide the cover between a released open position and a closed position, a first securing member and a first counterpart securing member that prevent the cover from lifting when in the closed position; and a first support bracket added on the frame that bears the first cam and the first securing member.

17 Claims, 9 Drawing Sheets

ROAD DEVICE

CROSS-REFERENCE TO RELATED APPLICATIONS

This application is a National Stage application of International Patent Application No. PCT/FR2011/050,960, filed on Apr. 28, 2011, which is incorporated by reference herein in its entirety, which claims the benefit of French Application No. 10 53341 filed Apr. 29, 2010, which is incorporated by reference herein in its entirety.

BACKGROUND OF THE INVENTION

The present invention relates to a road device, comprising:

an opening, a cover having a covering wall extending along a wall plane, a first hinge provided with a first cam and a first cam follower which are designed to guide the cover relative to the opening between a released open position and a closed position, and securing means that prevent the cover from lifting, in the closed position, in a direction perpendicular to the wall plane, the securing means comprising a first securing member and a first counterpart securing member.

Road devices are known, for example access hatches for telecommunications facilities, having a frame delimiting an opening and a cover designed to cover the opening. The cover has maneuvering recesses in which a maneuvering tool is inserted so as to place the cover in the frame or remove the cover from the frame. It is not easy to maneuver the cover using the tool.

These access hatches also have securing means which, in the closed position, prevent the cover from being removed from the frame. The securing means have a large number of detached parts and are difficult and expensive to assemble.

BRIEF SUMMARY OF THE INVENTION

The invention aims to offset these drawbacks and propose a road device that is easier to assemble and handle.

Another aim of the invention is to offset these drawbacks while making it possible to retrofit existing road devices.

To that end, the invention relates to a road device, of the type indicated above, characterized in that the road device comprises a first support bracket bearing the first cam and the first securing member.

According to specific embodiments, the road device comprises one or more of the following features:

the road device comprises a second hinge designed to guide the cover between the released open position and the closed position and provided with a first additional cam and a first additional cam follower, the securing means having a second securing member and a second counterpart securing member, and the road device comprises a second support bracket bearing the first additional cam and the second securing member;

the first cam and the first securing member of the or each support bracket are secured to one another, are in particular made in a single piece, and are preferably integral with one another;

the first cam of the or each support bracket comprises a first cam surface and a second cam surface, these two cam surfaces extending on either side of a cam plane of symmetry;

the or each support bracket comprises a first securing surface and a second securing surface extending on either side of a securing plane of symmetry, and in the case where the device comprises two support brackets, the first securing surfaces of the first and second support brackets are situated on the same side of the securing plane of symmetry of the concerned support bracket, and the second securing surfaces of the first and second support brackets are situated on the same side of the securing plane of symmetry of the concerned support bracket, the first securing member forming the first securing surface of the first support bracket, and the second securing member forming the second securing surface of the second support bracket;

at least the first counterpart securing member is formed by a first recess for maneuvering the cover and, if applicable, the second counterpart securing member is formed by a second recess for maneuvering the cover;

the or each support bracket has a blocking recess adapted to define a blocked open position of the cover, the blocking recess having at least one blocking surface designed to prevent the cover from tilting toward the closed position when the cover is in the blocked open position;

the road device has at least one inhibiting element either designed to inhibit or inhibiting the cover from going from the released open position to the blocked open position;

the road device has a frame delimiting the opening and a first fastening member designed to fasten the support bracket to the frame, and if applicable a second fastening member designed to fasten the second support bracket to the frame;

the inhibiting element includes the first fastening member, and in particular a crosspiece; and the or each support bracket is manufactured in a single piece, in particular cast iron.

DESCRIPTION OF THE DRAWINGS

The invention will be better understood upon reading the following description, provided solely as an example and done in reference to the appended drawings, in which.

DETAILED DESCRIPTION OF THE INVENTION

Figure 1:
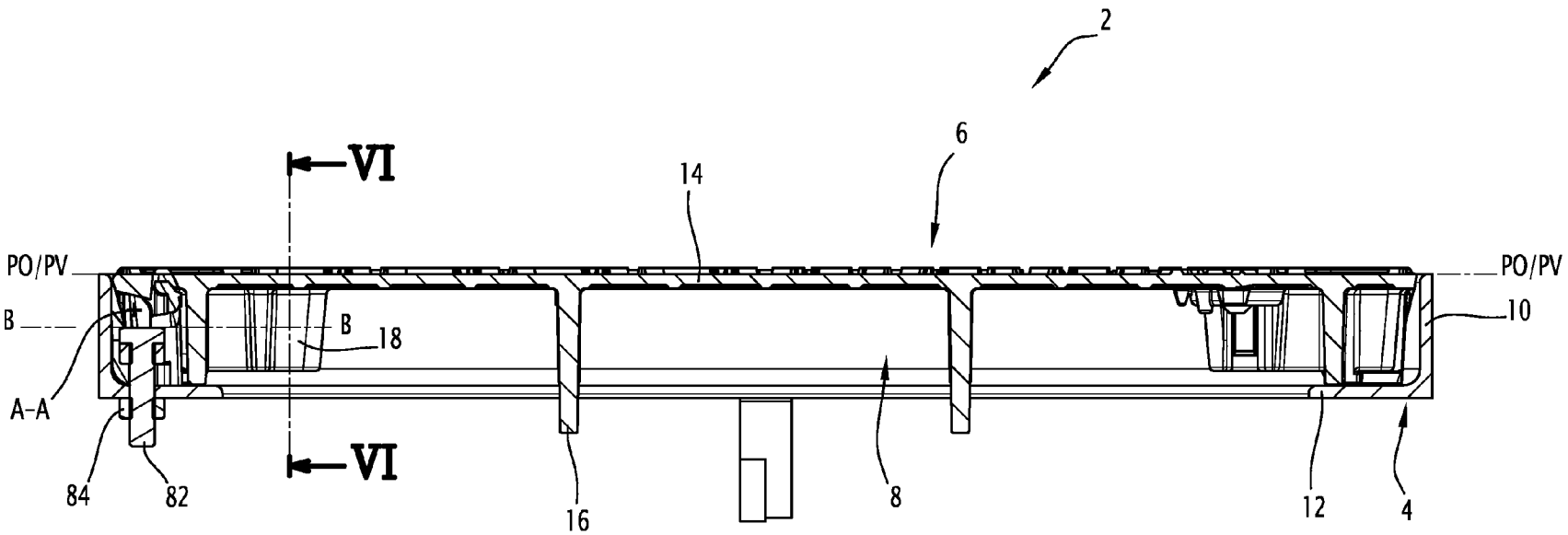
FIG. 1 is a cross-sectional view of a road device according to the invention in the closed state.

FIG. 1 shows a road device according to the invention, designated by general reference 2. The road device 2 is for example a manhole cover or access hatch for an underground chamber, such as a telecommunications hatch.

The road device 2 comprises a frame 4 and a cover 6, for example made from cast iron. The frame 4 delimits an opening 8, which is for example an access opening for underground telecommunications facilities or an underground inspection chamber. The opening 8 extends along an opening plane PO-PO substantially parallel to the ground in the installed state.

The frame 4 comprises a wall wing 10 extending perpendicular to the opening plane PO-PO as well as a support wing 12 extending parallel to the opening plane PO-PO.

Figure 9:
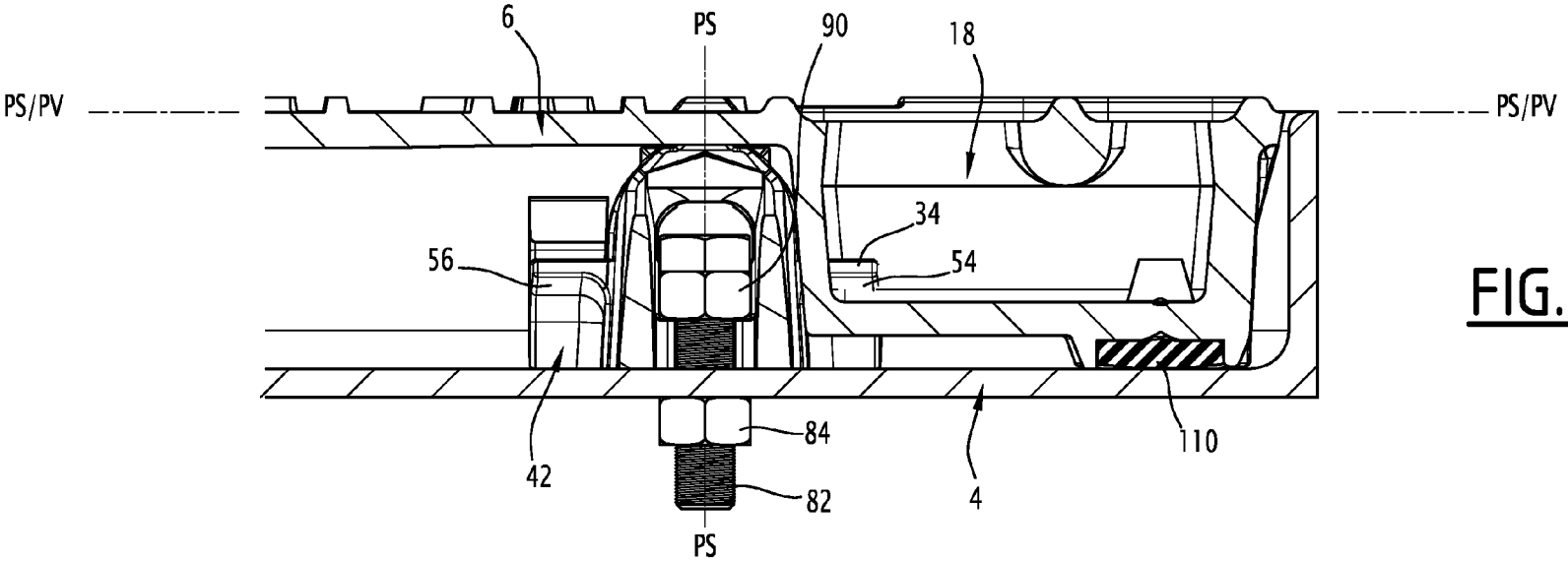
FIG. 9 is an enlarged view of detail IX of FIG. 6.

The cover 6 comprises a covering wall 14 extending in a wall plane PV-PV, a stiffening structure 16, and four maneuvering recesses 18 (for example, see FIG. 9).

Figure 2:
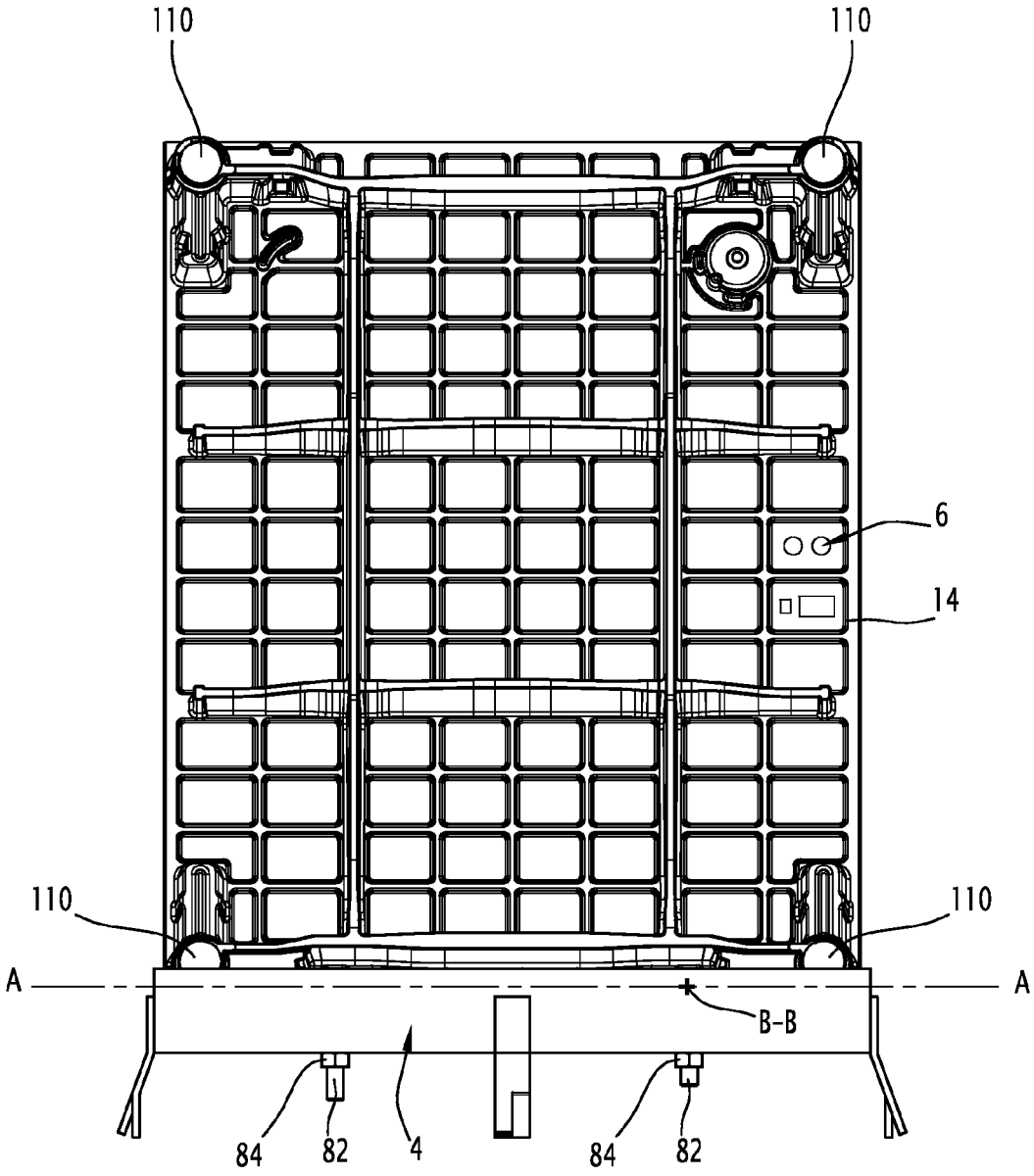
FIG. 2 is a front view of the road device of FIG. 1 in the completely open state.
Figure 3:
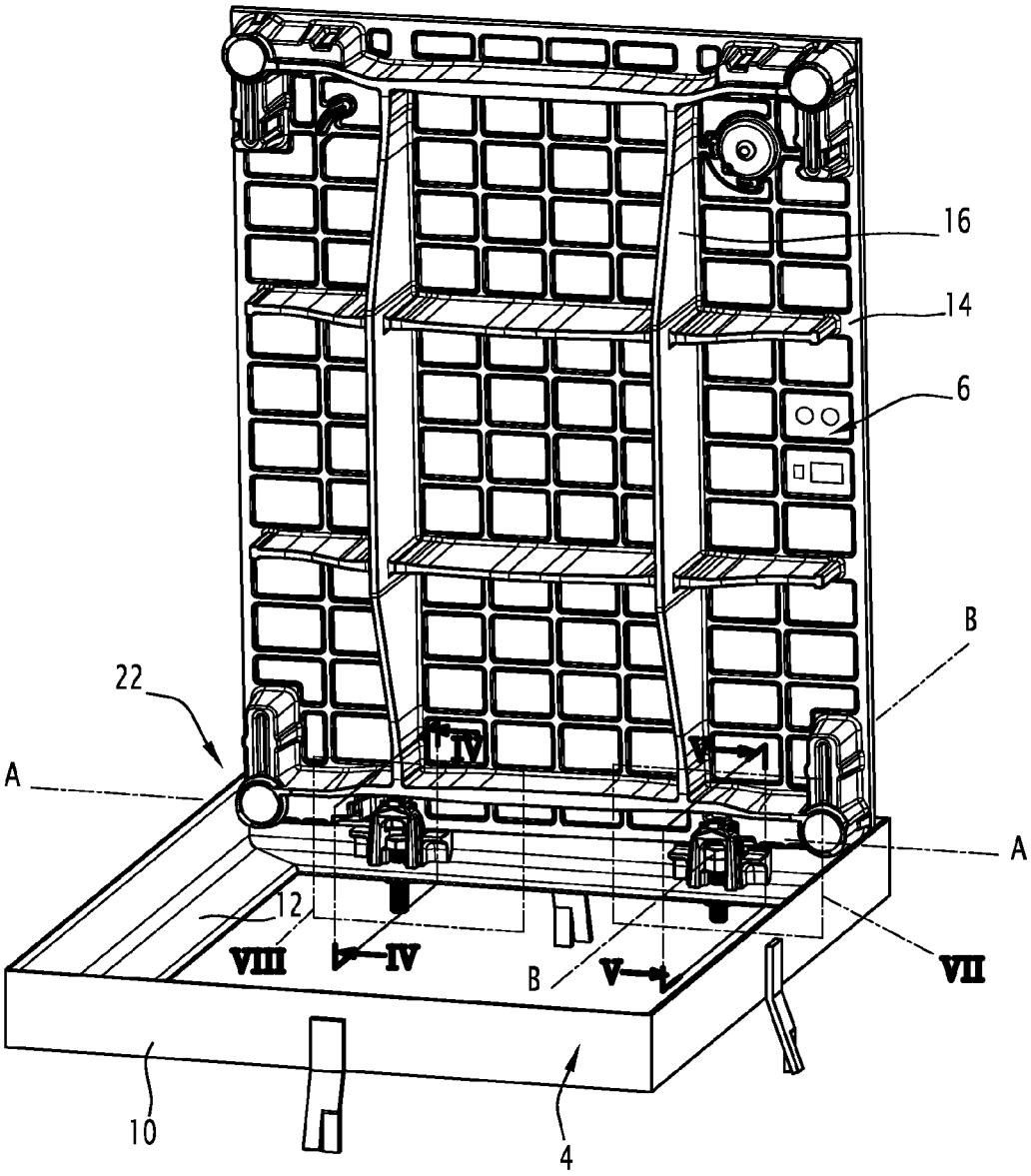
FIG. 3 is a perspective view of the road device of FIG. 1 in the blocked open state.

The road device 2 defines a closed state (FIG. 1), a released open state (FIG. 2), and a blocked state (FIG. 3). In the closed state, the cover 6 is in a closed position in which it is situated in the opening 8 and covers it. In that case, the plane PV-PV is parallel to the plane PO-PO. In the open position, the cover 6 can move between two open positions, i.e. a released open position (FIG. 2) and a blocked open position (FIG. 3). In the released open state, the cover 6 is in a position in which it can be tilted in the closing direction exclusively around a first pivot axis A-A, relative to the closed state or in which it may be radially offset relative to that axis A-A. In the blocked open state, the cover is prevented from tilting toward its closed position, but can be tilted around the pin A-A in an extreme open position in which the covering wall 14 is moved by more than 90° relative to its closed position, and is for example tilted by 110°. The cover 6 can also be brought from the blocked open state to the released open state through rotation around a blocking axis B-B extending perpendicular to the axis A-A.

The road device 2 has a first hinge 20 and a second hinge 22. The hinges 20, 22 are designed to guide the cover 6 between the closed position and the released open position. In the released open position, the plane PV-PV forms an angle of 90° or more relative to the plane PO-PO, compared to the closed position.

Figure 4:
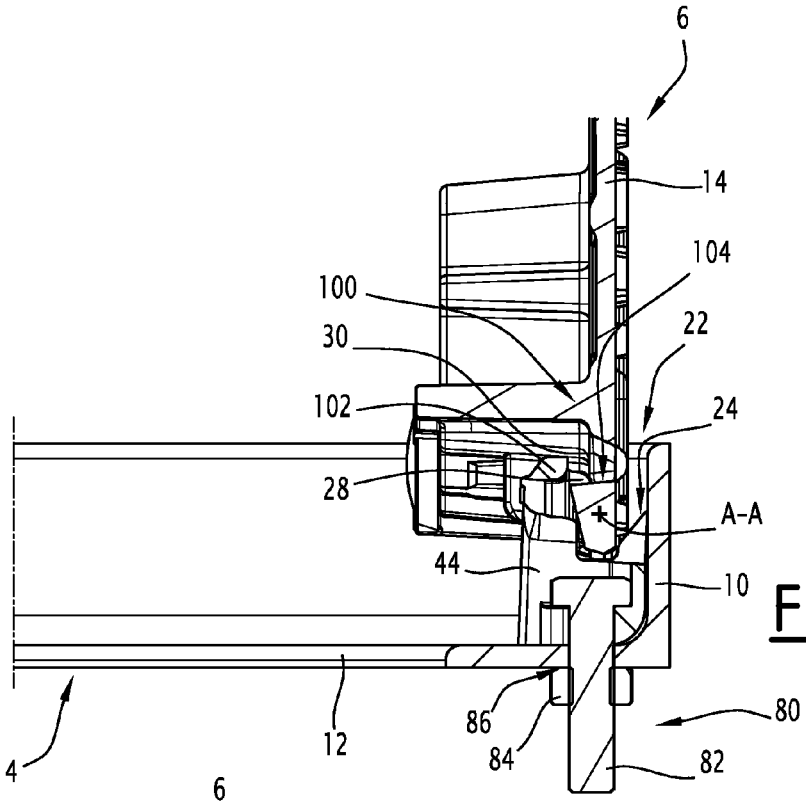
FIG. 4 and FIG. 5 are cross-sectional views of the road device according to the invention in the blocked open state, FIG. 4 being a cross-sectional view along line IV-IV of FIG. 3 through a first hinge and FIG. 5 being a cross-sectional view along line V-V of FIG. 3 through a second hinge.
Figure 5:
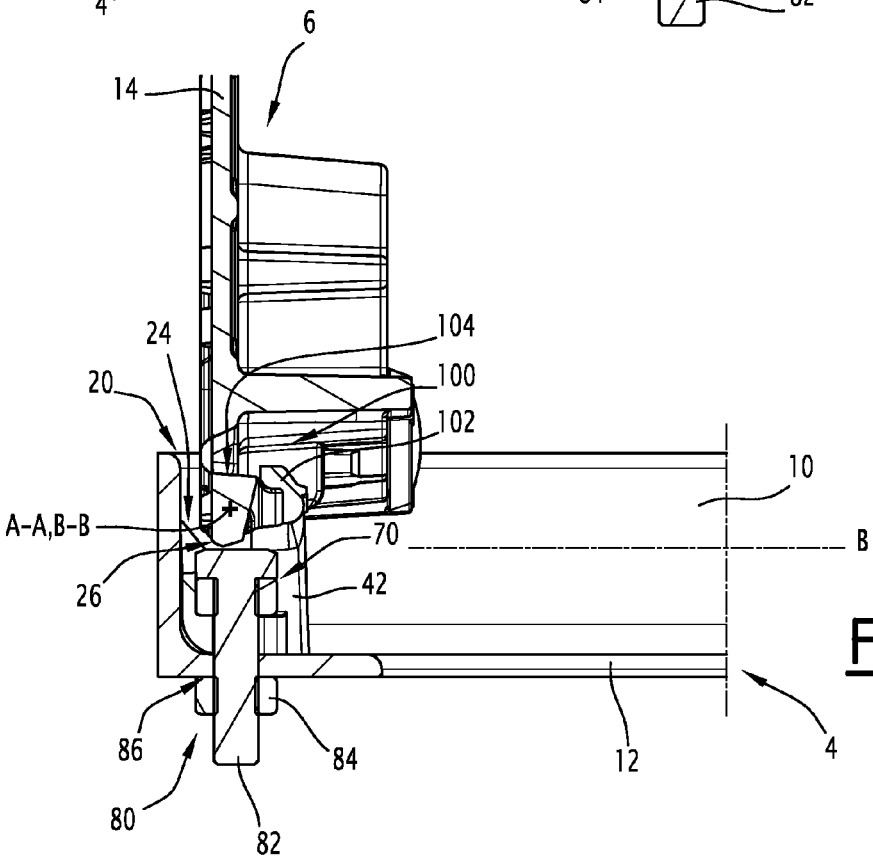

The first hinge 20 is provided with a first cam 24, stationary relative to the opening 8 and in the present case relative to the frame 4, and a first cam follower 26 stationary relative to the cover 6 (FIG. 5). The second hinge 22 is provided with a first additional cam 24, stationary relative to the opening 8 and in the present case relative to the frame 4, and a first additional cam follower 26 stationary relative to the cover 6 (FIG. 4).

The first cams 24 and the first cam followers 26 are designed to guide the cover 6 between the released open position and the closed position. To that end, the first cam followers 26 bear on the first cams 24 over an angular opening range of at least 60°. More specifically, the first cams 24 and first cam followers 26 bear on one another from an opening angle of 10° relative to the closed position and as far as an opening angle of 90° relative to the closed position.

The first cam followers 26 are formed by one edge of the cover 6.

Figure 7:
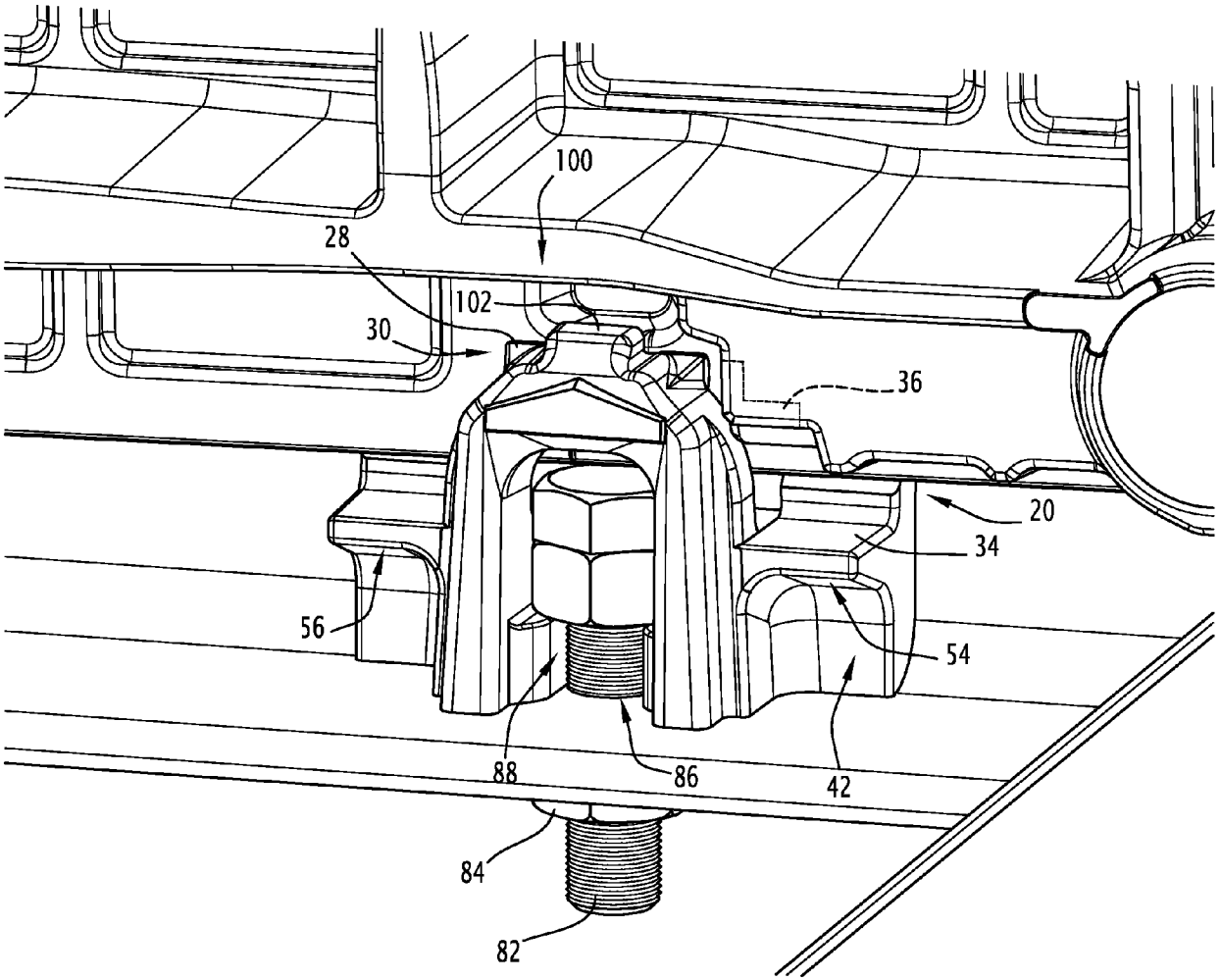
FIGS. 7 and 8 are enlarged views of details VII and VIII, respectively, of FIG. 3.

The first hinge 20 is provided with a second cam 28 (cf. FIG. 11), stationary relative to the opening 8 and in the present case relative to the frame 4, and a second cam follower 30 stationary relative to the cover 6 (FIG. 7). The second hinge 22 is provided with a second additional cam 28, stationary relative to the opening 8 and in the present case relative to the frame 4, and a second additional cam follower 30 stationary relative to the cover 6 (FIG. 4).

The second cams 28 and cam followers 30 bear on one another over an angular range of the cover 6 going from 0° or substantially 0°, i.e. the closed position, to an opening angle of 90° relative to the closed position.

The second cam followers 30 are formed by a lower surface of the cover 6.

Figure 12:
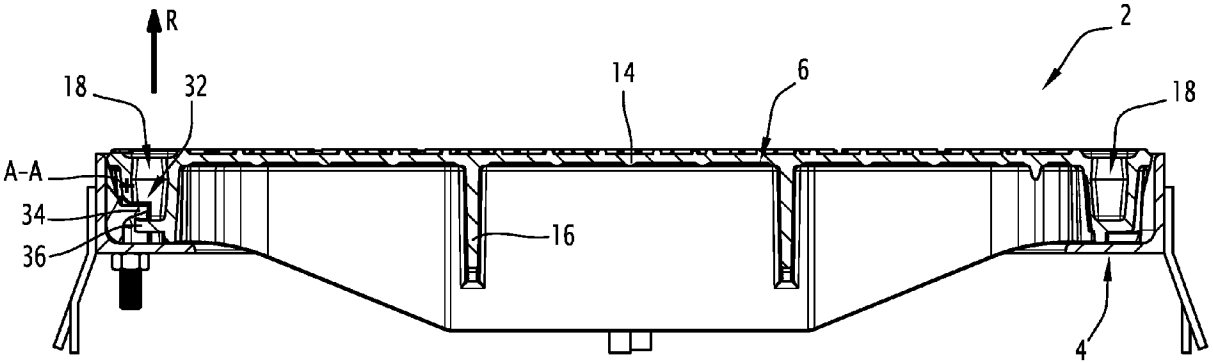
FIG. 12 shows the road device in cross-section along line XII-XII of FIG. 6.
Figure 13:
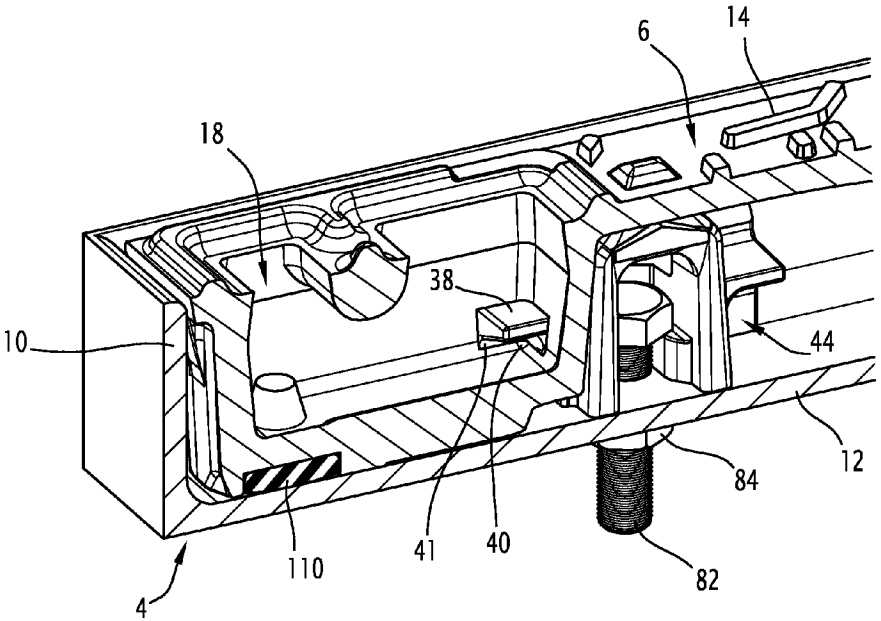
FIG. 13 shows a detail of the road device in perspective view and with a partial tear-away.

The road device 2 also comprises securing means 32 (see FIGS. 12 and 13). These securing means 32 define, in the closed position of the cover 6, an engaged configuration in which they prevent lifting of the cover 6 in a lifting direction R oriented perpendicular to the plane PO-PO by moving the cover 6 away from the support wing 12, when the lifting force is applied to the cover 6 near the hinges 20, 22.

In the released open position, the securing means 32 define a released configuration in which they do not prevent lifting of the cover 6 in the lifting direction R, thereby allowing the cover 6 to be removed. More specifically, the securing means 32 define the configuration engaged over an angular range extending from the closed position of the cover 6 to an opening angle of 15° of the cover 6 relative to the closed position. The securing means 32 define the released configuration over an angular range extending from the opening angle of 15° of the cover 6 relative to the closed position and up to an opening angle of 90° relative to the closed position. In other words, the securing means 32 are active only when the cover 6 is in an angular position thereof between about 0° and 15°.

When the cover 6 is tilted to the closed position, the securing means 32 automatically go from the released configuration to the engaged configuration and vice versa.

The securing means 32 comprise a first securing member 34, stationary relative to the opening 8 and in the present case relative to the frame 4, and a first counterpart securing member 36 stationary relative to the cover 6. The securing means 32 also have a second securing member 38, stationary relative to the opening 8 and in the present case relative to the frame 4, and a second counterpart securing member 40, stationary relative to the cover 6.

The or each securing member 34, 38 has a rib extending parallel to the opening plane PO-PO and radially offset from the axis A-A.

The first counterpart securing member 36 is in this case formed by a first of the maneuvering recesses 18 of the cover (FIG. 7) and the second counterpart securing member 40 is formed by a second of the maneuvering recesses 18 of the cover 6. More specifically, the counterpart securing members 36, 40 are formed by a notch 41 made in the wall of the concerned recess 18.

The road device 2 comprises first and second support brackets 42, 44.

According to the invention, the first support bracket 42 bears the first cam 24 and the first securing member 34. The second support bracket 44 bears the first additional cam 24 as well as the second securing member 38.

Each support bracket 42, 44 is an individual part made in a single piece, in particular by molding, and preferably from cast iron. As a result, the first securing member 34 is secured to the first cam 24, and they are made in a single piece. Furthermore, they are integral with one another. Likewise, the second securing member 38 and the first additional cam 24 are secured to one another and made in a single piece. Moreover, they are integral with one another.

Each support bracket 42, 44 is a distinct individual piece of the frame 4 and is a piece attached to that frame 4.

Figure 10:
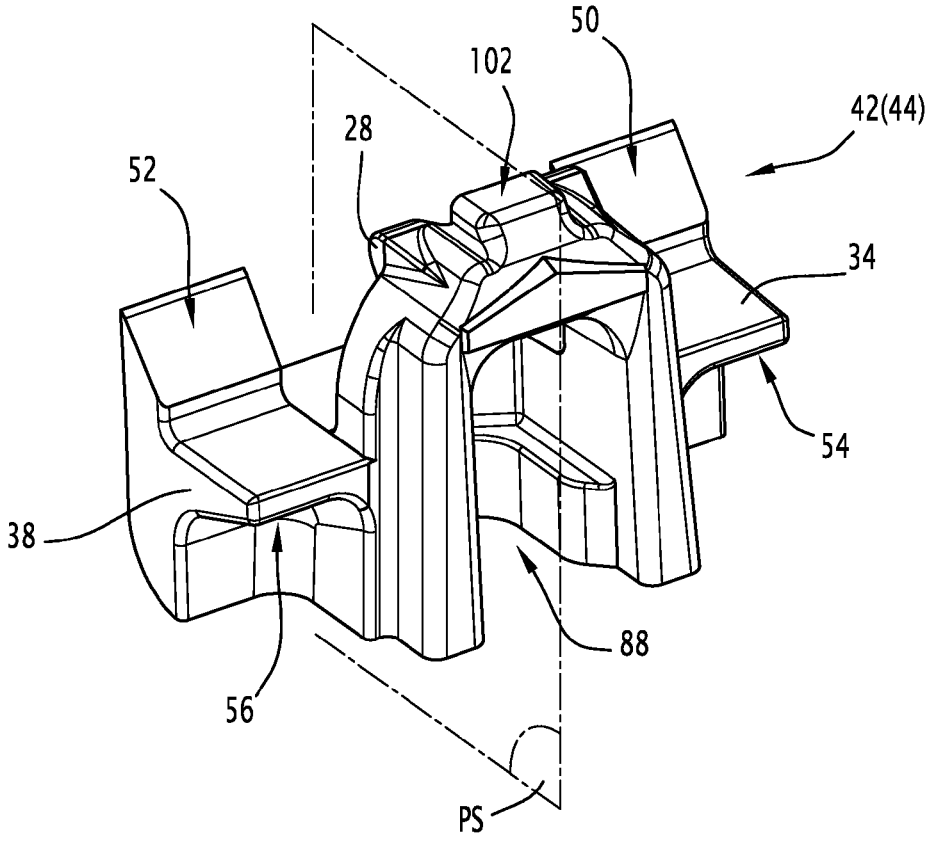
FIG. 10 is a perspective view of a support bracket.

FIG. 10 shows the support bracket according to the invention. The support brackets 42 and 44 are identical. Each support bracket 42, 44 is symmetrical relative to a plane of symmetry PS. Each support bracket 42, 44 comprises a first cam surface 50 and a second cam surface 52. The two cam surfaces 50, 52 extend symmetrically on either side of the plane of symmetry PS, and the plane of symmetry PS therefore forms a cam plane of symmetry.

Figure 11:
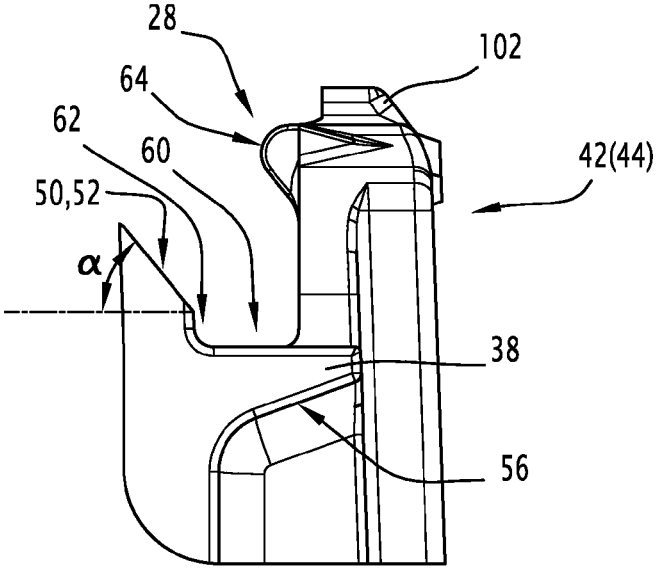
FIG. 11 shows the support bracket of FIG. 10 from the side.

Each cam surface 50, 52 is a planar surface that extends over an angle $\alpha$ relative to the opening plane (FIG. 11). The angle α is comprised between 45° and 60°. In the mounted state of the support brackets 42, 44, each cam surface 50, 52 is adjacent to the wall wing 10.

The support bracket 42, 44 comprises a first securing surface 54 and a second securing surface 56. The first securing surface 54 and the second securing surface 56 extend symmetrically on either side of the plane of symmetry PS, and the plane of symmetry PS forms a securing plane of symmetry.

Figure 6:
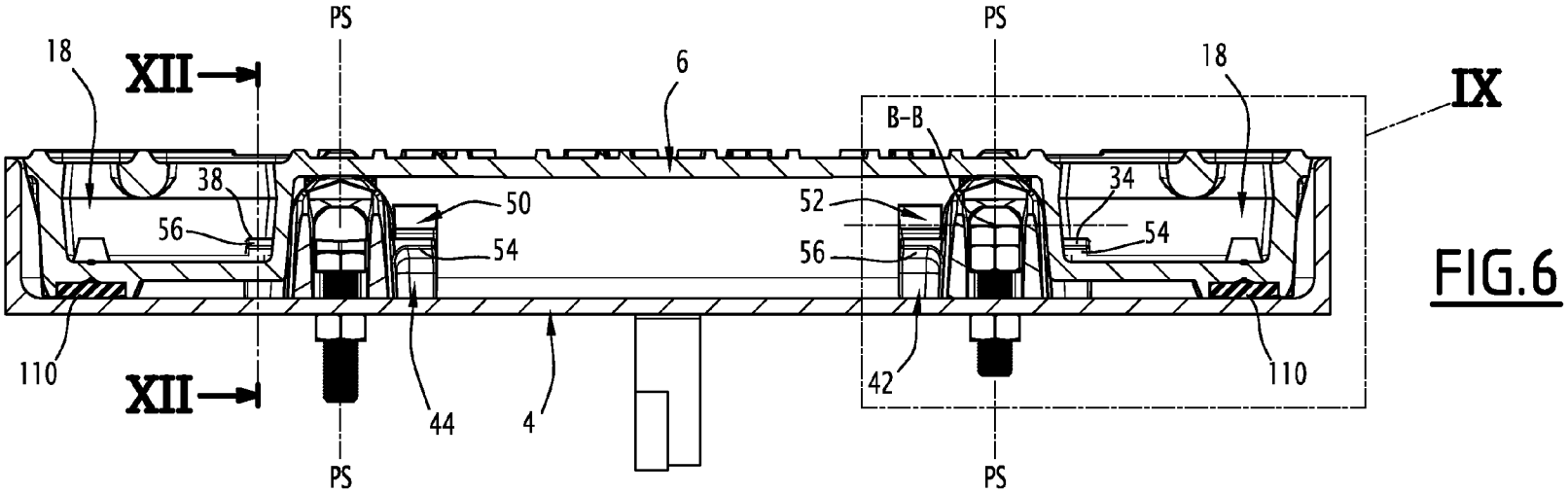
FIG. 6 is a cross-sectional view of the road device along line VI-VI of FIG. 1.

As shown in particular in FIG. 6, the two first securing surfaces 54 of the two support brackets 42, 44 are situated on the same side of the plane of symmetry PS of each concerned support bracket 42, 44 and the second securing surfaces 56 of the two support brackets 42, 44 are situated on the same side of the plane of symmetry PS of the concerned support bracket.

The first securing surface 54 of the first support bracket 42 is formed by the first securing member 34, and the second securing surface 56 of the second support bracket 44 is formed by the second securing member 38.

Each support bracket 42, 44 also comprises a blocking recess 60 (see FIG. 11) designed to receive the cover and to define the blocked open position of the cover. The blocking recess 60 has a first blocking surface 62 and a second blocking surface 64 (FIG. 1) designed to prevent the cover 6 from tilting to the closed position when the cover is in the blocked open position. In this case, the second blocking surface 64 is formed by the second cam 28.

Figure 8:
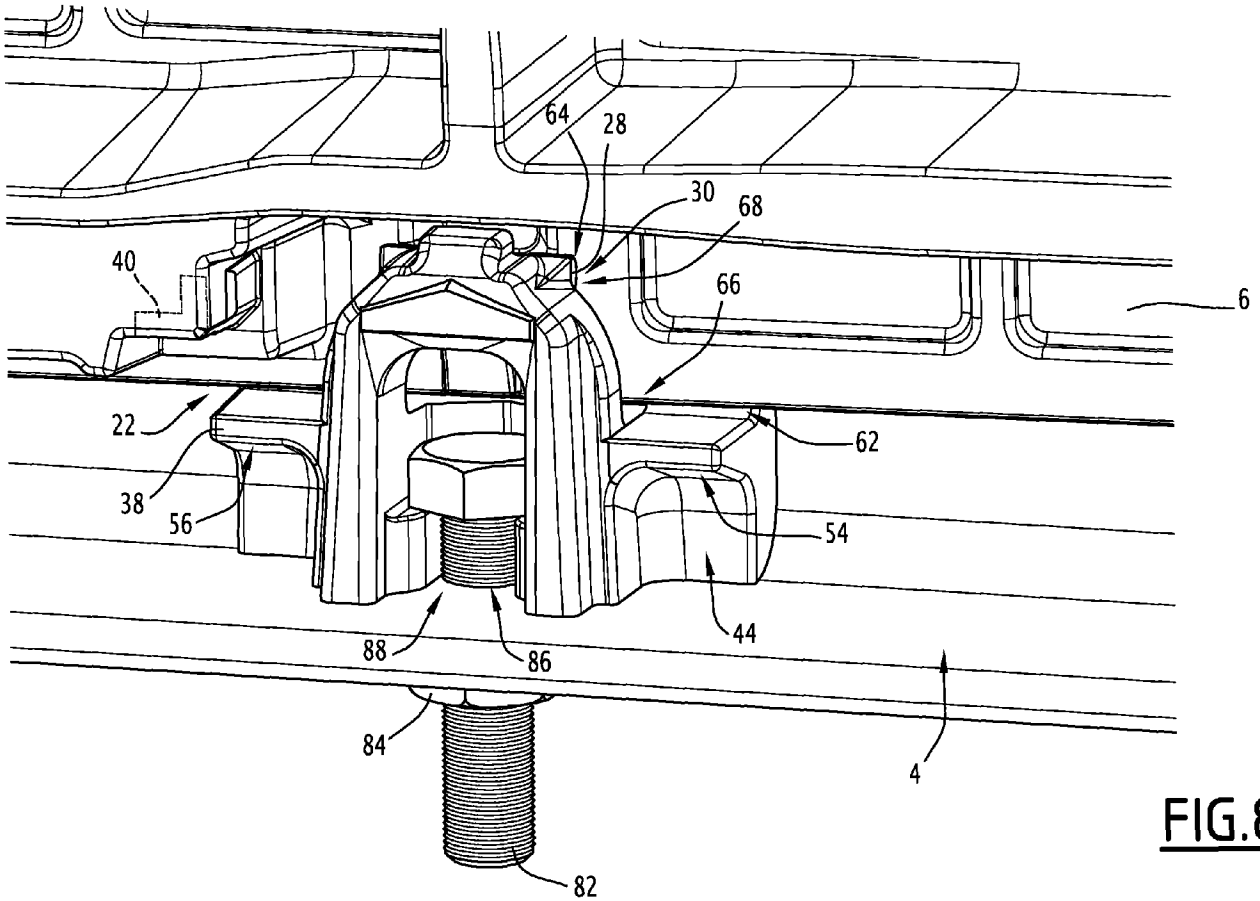

The cover 6 comprises first 66 and second 68 associated counterpart blocking surfaces (FIG. 8). In the case at hand, the second counterpart blocking surface 68 is formed by the cam follower 30.

The road device 2 has an inhibiting element 70 (see FIG. 5) either designed to inhibit or inhibiting the engagement of the cover 6 in the blocking recess 60 of the first support bracket 42. In this way, the inhibiting element 70 prevents the cover 6 from going from its released open position to its blocked open position in the support bracket 42. The road device 2 is devoid of an additional inhibiting element designed to inhibit the engagement of the cover 6 in the blocking recess 60 of the second support bracket 44. Thus, passage of the cover 6 from its released open position to its blocked open position in the support bracket 44 is allowed.

The road device 2 comprises fastening means 80 for each of the support brackets 42, 44 designed to fasten the support bracket 42, 44 to the frame 4.

These fastening means 80 on the one hand have a screw 82 and a nut 84, and on the other hand a hole 86 formed in the frame 4 as well as a receiving notch 88 formed in the support bracket 42, 44.

The road device 2 also comprises a crosspiece 90 arranged between the head of the screw 82 and the reception notch 88 of the first support bracket 42. In this way, the inhibiting element 70 is formed by the screw 82. In the described embodiment, the crosspiece 90 is formed by an additional nut.

The road device also comprises stop means 100 designed to oppose translational movement of the cover in the plane PV-PV in the closed state and during closure.

These stop means comprise a stop 102 arranged on each of the support brackets 42, 44 and an associated counterpart stop 104 arranged on the cover. In the case at hand, each stop 102 is formed by an abutment nose arranged on the central end of the support bracket 42, 44. Each counterpart stop 104 is formed by a surface of a recess formed in the cover 6. The stop 102 is received in the recess forming the counterpart stop 104 in the closed state. In the case where the road device 2 is provided with an assistance jack biasing the cover toward the open position, the stop 102 and the counterpart stop 104 form a cam and cam follower, which cooperate during closure. During this cooperation, the cams 24 and cam follower 26 are not in contact.

Furthermore, the road device 2 comprises lugs 110 made from plastic, for example rubber. The device 2 comprises four lugs 110, each of which is arranged at a corner recess 18. These lugs 110 are arranged in the closed state between the cover and the support wing 12 and the cover bears on the frame by means of said lugs 110 (cf. FIGS. 6 and 9).

The road device 2 is assembled as follows:

First, the crosspiece 90 is fastened on one of the screws 82.

The screw 82 bearing the crosspiece 90 is inserted into the reception notch 88 of the first support bracket 42. The insertion direction is oriented radially to the axis of the screw 82.

The first support bracket 42 is then arranged on the support wing 12 of the frame 4, in a direction oriented perpendicular to the opening plane PO-PO and by plugging the screw into the hole 86 formed in the support wing 12. The nut 84 is then tightened against the support wing 12.

Next, the screw 82 without the crosspiece is inserted into the reception notch 88 of the second support bracket 44, perpendicular to the axis of the screw. Then, the second support bracket 44 is arranged on the support wing 12 of the frame 4, in a direction oriented perpendicular to the opening plane PO-PO and plugging the screw 82 into the hole 86. Next, the nut 84 is tightened against the support wing 12.

The cover 6 is brought into its released open position by putting the first cover cam followers 26 in contact with the first cams 24 and is brought into its closed position by tilting around the axis A-A.

The operation of the road device 2 is as follows.

Initially, the road device is in the closed state.

The device defines a first angular tilting range of the cover 6 relative to the frame 4, which is delimited by the closed position and a first threshold angle that is for example 10°. In this first angular range, the lugs 110 adjacent to the hinges 20, 22 slide on the support wing 12, the first cam followers 26 slide over the wall wing 10, and the second cam followers 30 slide on the second cams 28.

The device defines a second angular tilting range of the cover 6 relative to the frame 4, which is delimited by the threshold angle and by a second threshold angle, which is for example 90° or the open position. Over this second angular range, the first cam followers 26 slide over the first cams 24, and the second cam followers 30 slide over the second cams 28. Over this second angular range, the lugs 110 are not in contact with the support wing 12.

The device defines a third angular range that is delimited by the second threshold angle and by a third threshold angle, which is for example 110°. During the passage from the second angular range to the third angular range, the cover 6 falls into the blocking recess 60 of the support brackets provided without an inhibiting element 70 and comes into contact with the inhibiting element of the support brackets provided with an inhibiting element. In the case of the device 2 shown in the figures, the cover slides around the axis B-B in its blocked open position.

Owing to the fact the support brackets 42, 44 bear the first cam 24 and the securing member, the assembly of the road device is made easier given that a single operation is needed to fasten each support bracket to the frame.

Alternatively, the road device does not comprise any inhibiting element 70. In that case, the cover 6 is received in the recesses 60 of each support bracket 42, 44 when it is in its blocked open position. The passage between the blocked position and the released open position is done by a translational shift of the cover 6 radially to the axis A-A and not by tilting the cover around the axis B-B. Also, according to another alternative, the road device 2 comprises an inhibiting element 70 for all of the support brackets 42, 44. In that case, the device does not have a blocked open position.

Because the two support brackets 42, 44 have identical features, a single type of support bracket can be manufactured so as to equip a road device with a hinge allowing blocking by tilting around an axis B-B perpendicular to the opening/closing axis A-A.

Also, the crosspiece 90 and the screws 82 are particularly simple and cost-effective.

Alternatively, the road device 2 comprises a frame and at least two covers 6. Each cover 6 is connected to the frame by two support brackets in the manner described above.

In this case, one cover is a master and the other cover(s) is(are) slave cover(s).

The above features may be dissociated from one another and may be combined according to all technically possible combinations.

The invention claimed is:

1. A road device comprising:

a frame (4) delimiting an opening (8);

a cover (6) having a covering wall (14) extending along a wall plane (PV);

a first hinge (20) provided with a first cam (24) and a first cam follower (26), which are designed to guide the cover relative to the opening between a released open position, a closed position, and a blocked open position;

a securing means (32) that prevents the cover, when in the closed position, from lifting in a direction (R) perpendicular to the wall plane, the securing means comprising a first securing member (34) and a first counterpart securing member (36);

a first support bracket (42) bearing the first cam (24) and the first securing member (34), said first support bracket (42) being a piece distinct from the frame (4) that is added on the frame (4);

a first fastening means (80) designed to fasten the first support bracket (42) to the frame (4), wherein the first fastening means is under the cover (6) when the cover is in its closed position; wherein the cover, when in the blocked position, is prevented from tilting toward the closed position, and wherein the fastening means further comprises at least one inhibiting element (70) for inhibiting the cover from going from the released open position to the blocked open position.

2. The road device according to claim 1, wherein the road device further comprises a second hinge (22) designed to guide the cover between the released open position and the closed position and provided with a first additional cam (24) and a first additional cam follower (26);

the securing means (32) further comprises a second securing member (38) and a second counterpart securing member (40);

the road device further comprises a second support bracket (44) bearing the first additional cam (24) and the second securing member (38), said second support bracket (44) being a piece distinct from the frame (4) that is added on the frame (4).

3. The road device according to claim 1, wherein the first support bracket (42) is an individual part made in a single piece.

4. The road device according to claim 1, wherein the first cam (24) and the first securing member (34) are secured to one another.

5. The road device according to claim 1, wherein the first cam (24) of the first support bracket comprises a first cam surface (50) and a second cam surface (52), these two cam surfaces extending on either side of a cam plane of symmetry (PS).

6. The road device according to claim 1, wherein the first support bracket (42) comprises a first securing surface (54) and a second securing surface (56), these two securing surfaces extending on either side of a securing plane of symmetry (PS), the first securing member (34) being formed by the first securing surface (54) of the first support bracket (42).

7. The road device according to claim 1, wherein at least the first counterpart securing member (36) is formed by a first recess (18) for maneuvering the cover.

8. The road device according to claim 1, wherein the first support bracket (42) has a blocking recess (60) adapted to define the blocked open position of the cover, the blocking recess having at least one blocking surface (62, 64) designed to prevent the cover from tilting toward the closed position when the cover is in the blocked open position.

9. The road device according to claim 1, wherein the first support bracket (42) is manufactured in a single piece.

10. The road device according to claim 2, wherein each of the first support bracket and the second support bracket is an individual part made in a single piece.

11. The road device according to claim 2, wherein the first cam (24) and the first securing member (34) of the first support bracket (42) are secured to each other, and the first additional cam (24) and the second securing member (38) of the second support bracket (44) are secured to each other.

12. The road device according to claim 2, wherein each of the first cam (24) of the first support bracket (42) and the first additional cam (24) of the second support bracket (44) comprises a first cam surface (50) and a second cam surface (52), these two cam surfaces extending on either side of a cam plane of symmetry.

13. The road device according to claim 2, wherein the first support bracket (42) comprises a first securing surface (54) and a second securing surface (56), these securing surfaces extending on either side of a first securing plane of symmetry, and the second support bracket (44) comprises a first securing surface (54) and a second securing surface (56), these securing surfaces extending on either side of a second securing plane of symmetry, the first and second planes of symmetry being parallel to each other, the first securing surface (54) of the second support bracket (44) being situated on the same side, relative to the second plane of symmetry, as the first securing surface (54) of the first support bracket (42) relative to the first plane of symmetry, and the second securing surface (56) of the second support bracket (44) being situated on the same side, relative to the second plane of symmetry, as the second securing surface (56) of the first support bracket (42) relative to the first plane of symmetry, the first securing member (34) being formed by the first securing surface (54) of the first support bracket (42) and the second securing member (38) being formed by forming the second securing surface (56) of the second support bracket (44).

14. The road device according to claim 2, wherein at least the first counterpart securing member is formed by a first recess for maneuvering the cover and at least the second counterpart securing member is formed by a second recess for maneuvering the cover.

15. The road device according to claim 2, wherein each of the first support bracket and the second support bracket has a blocking recess adapted to define the blocked open position of the cover, the blocking recess having at least one blocking surface designed to prevent the cover from tilting toward the closed position when the cover is in the blocked open position.

16. The road device according to claim 2, wherein the road device further comprises a second fastening means (80) designed to fasten the second support bracket to the frame, wherein said second fastening means is under the cover (6) when the cover is in its closed position.

17. The road device according to claim 2, wherein each of the first support bracket and the second support bracket is a single piece.

* * * * *